US011787673B2

(12) United States Patent
Oelberger et al.

(10) Patent No.: US 11,787,673 B2
(45) Date of Patent: Oct. 17, 2023

(54) MOBILE CRANE COMPRISING A SUPERSTRUCTURE HAVING AT LEAST ONE BEARING POINT FOR PINNING ON A BOOM

(71) Applicant: Liebherr-Werk Ehingen GmbH, Ehingen/Donau (DE)

(72) Inventors: Franz Oelberger, Senden (DE); Mario Helbig, Munderkingen (DE); Andreas Bronner, Oberdischingen (DE)

(73) Assignee: LIEBHERR-WERK EHINGEN GMBH, Ehingen/Donau (DE)

( * ) Notice: Subject to any disclaimer, the term of this patent is extended or adjusted under 35 U.S.C. 154(b) by 46 days.

(21) Appl. No.: 17/457,005

(22) Filed: Nov. 30, 2021

(65) Prior Publication Data

US 2022/0169483 A1 Jun. 2, 2022

(30) Foreign Application Priority Data

Nov. 30, 2020 (DE) ..... 10 2020 131 617.8

(51) Int. Cl.
*B66C 23/62* (2006.01)
*B66C 23/36* (2006.01)

(52) U.S. Cl.
CPC ..... *B66C 23/62* (2013.01); *B66C 23/36* (2013.01); *B66C 2700/0371* (2013.01)

(58) Field of Classification Search
CPC ..... B66C 23/62; B66C 23/82; E02F 9/006; Y10T 403/32877
See application file for complete search history.

(56) References Cited

U.S. PATENT DOCUMENTS 3,684,324 A 8/1972 Sterner
3,847,488 A * 11/1974 Gossage ..... B66C 23/62 403/91
4,337,867 A * 7/1982 Spain ..... B66C 23/62 212/181
8,534,474 B2 * 9/2013 Holly ..... B66C 23/70 212/177
8,739,988 B2 * 6/2014 Walker ..... B66C 23/76 212/175
9,279,230 B2 * 3/2016 Wager ..... E02F 3/3695
9,815,674 B2 * 11/2017 Foust ..... B25B 27/04
(Continued)

FOREIGN PATENT DOCUMENTS

DE 2136464 A1 7/1972

*Primary Examiner* — Michael R Mansen
*Assistant Examiner* — Juan J Campos, Jr.
(74) *Attorney, Agent, or Firm* — McCoy Russell LLP

(57) ABSTRACT

The disclosure relates to a mobile crane comprising a superstructure having at least one bearing point for pinning on a boom, wherein the bearing point comprises two spaced apart side parts that each have a bore for receiving the pin; and wherein the boom comprises at least one connection part that is provided with a bore and that can be introduced between the side parts such that a common connection pin can be pushed through the bores of the side parts and the connection part, wherein the clear width between the side parts is larger than the width of the connection part of the boom, and wherein a step pin is provided as a connection pin and its formed shoulder forms an abutment for the connection part of the pinned boom in the pinned position.

11 Claims, 3 Drawing Sheets

(56) References Cited

U.S. PATENT DOCUMENTS

| | | | | |
|---|---|---|---|---|
| 2004/0060210 | A1* | 4/2004 | Nishimura | E02F 3/3604 37/465 |
| 2008/0089627 | A1* | 4/2008 | Yamamoto | F16C 11/0614 384/473 |
| 2010/0226710 | A1* | 9/2010 | Yamasaki | E02F 3/302 403/81 |
| 2011/0147331 | A1* | 6/2011 | Tanaka | B66F 17/00 212/299 |
| 2013/0142606 | A1* | 6/2013 | Wager | E02F 3/3695 414/686 |
| 2015/0299979 | A1* | 10/2015 | Voss | E02F 3/382 29/525.08 |

* cited by examiner

MOBILE CRANE COMPRISING A SUPERSTRUCTURE HAVING AT LEAST ONE BEARING POINT FOR PINNING ON A BOOM

CROSS-REFERENCE TO RELATED APPLICATION

The present application claims priority to German Patent Application No. 10 2020 131 617.8 filed on Nov. 30, 2020. The entire contents of the above-listed application is hereby incorporated by reference for all purposes.

TECHNICAL FIELD

The disclosure relates to a mobile crane comprising a superstructure having at least one bearing point for pinning on a boom.

BACKGROUND

As a rule, mobile crane comprise an undercarriage as a chassis. A superstructure can be rotatably placed onto the undercarriage via a rotary connection about a vertical axis. The crane boom is pivotally connected to the superstructure. A decisive criterion in the design of a mobile crane is the total weight as legally regulated maximum axle loads have to be observed for driving operation in public road transport. A possibility of dismantling the boom is therefore frequently provided with large mobile cranes.

SUMMARY

Such a dismantling capability of the boom is, however, only offered at the request of the customer since it is associated with a substantial increased effort. A pin pulling device thus has to be installed on the crane, for example, to be able to push/pull the pins for the fastening of the boom to the superstructure for installation/disassembly. The typically hydraulic drive of the pin pulling device requires the laying of any required hydraulic and control lines. The pin connection of the luffing cylinder to the boom also has to be retrofitted accordingly.

The pin connection between the superstructure and the boom comprises two spaced apart side parts of the superstructure between which a connection part of the boom can be introduced. A connection pin is subsequently pushed through the aligned bores within the side parts and the connection part. The spacing of the side parts, i.e. their clear width is coordinated with the width of the connection part to limits the axial play of the connection part, i.e. a relative movement between the connection part and the side parts, as much as possible in the axial direction of the pin. There is, however, a disadvantage in that the installation/dismantling of the boom is made more difficult as the play decreases.

An auxiliary crane, for example, takes up the boom on the dismantling of the boom. The pin pulling device subsequently pulls out the two boom pins and the connection to the luffing cylinder is released. The boom is thereby free and the auxiliary crane can lift it and subsequently place it onto a transport apparatus. On the installation or dismantling of the boom with only an auxiliary crane, however, the small play between the steel construction of the superstructure and the boom can have the result that the boom can rotate about the longitudinal boom axis due to tolerances in the chain suspension, the suspension lugs, and the fastening points on the linkage piece. If such a rotational movement occurs, the boom can jam within the side parts of the bearing points of the superstructure, which can represent a situation for the total installation procedure that is complicated to overcome.

It is therefore necessary to find a compromise between axial play and handling during the installation/dismantling of the boom. However, a setup with as little play as possible is desirable to avoid relative movements between the boom and the superstructure construction, but to increase the play for the installation procedure to simplify the work there.

It is proposed in accordance with the disclosure that the clear width between the side parts of the bearing point of the superstructure has larger dimensions than the width of the connection part of the boom to be inserted there. This is a requirement for an axial play between the side parts and the inserted connection part. An axial play of, for instance, 5 mm between each side of the connection part and the oppositely disposed side part is ideal, for example. In this case, the clear width between the side parts is 10 mm larger than the width of the connection part. An axial play of at least 5 mm per side would be sufficient for a smooth and fast installation and dismantling procedure. It is pointed out that the disclosure is independent of the exact dimensioning of the play. The key idea of the disclosure namely comprises compensating an axial play provided for construction reasons due to the above-described design specification by means in accordance with the disclosure in crane operation. The use of such means is, however, independent of the actual play.

To compensate the structurally induced axial play in the installed state of the crane ready for operation, it is proposed in accordance with the disclosure to use a step pin as the connection pin. Such a step pin is characterized by a step-like diameter change, whereby the step pin forms a step that is also called a shoulder in the following. The shoulder that is formed serves as an axial abutment for the connection part in the pushed-in state of the step pin to limit the axial play between the side part and the connection part.

In this respect, the shoulder projects at least partially into the space between the side parts, i.e. into the remaining free space between the connection part and the oppositely disposed side part. The bore diameter of the connection part has smaller dimensions than the diameter of the shoulder. In this manner, a sufficient play for a smooth installation/dismantling is provided between the connection part and the side part with a pulled-out connection pin. After the pushing in of the connection pin, this play is bounded by the shoulder so that no or only a considerably reduced relative movement is possible between the connection part and the side parts in the axial direction of the connection pin.

The pin is typically pushed in the direction of the boom luffing axis to connect the boom to the superstructure. At least two pin connections may be pushed in separately for the boom installation, with the at least two pins ideally both being designed as step pins. In some embodiments, the step pins are pushable in the direction toward the luffing axis, with the shoulder of each pin connection in this case being between the outwardly disposed side part and the connection part.

The connection part of the boom comprises a bore for receiving the step pin. A bushing may be inserted into the bore with an exact fit. The diameter of the pronounced shoulder of the step bolt has larger dimensions than the diameter of the bushing so that the outwardly disposed front face of the bushing abuts the oppositely disposed shoulder of the pushed-in step pin and a movement of the boom toward the superstructure in the axial direction is thereby prevented.

At least one pin pulling device that is typically designed as a hydraulic device is respectively provided for the automatic actuation of the one or more step pins. It is conceivable in this connection that the step pin is designed as hollow and thus itself serves as a cylinder for the hydraulic drive of the pin pulling device. The required setting piston is fixed in a static manner to the superstructure and projects into the hollow space of the step pin. By applying pressure to the hollow space of the step pin, the latter can be actuated and can be moved in the linear direction on the static setting pin. A termination of the open pin side with an integral rod leadthrough provides the pressure-tight closure of the hollow step pin.

Since the bore diameter of the side parts, at least that of the outwardly disposed side part, is coordinated with the shoulder diameter and since the pin diameter, however, varies over the possible displacement path on the pushing/pulling of the pin due to the step, an additional guidance of the step pin has to be provided over the total displacement path to support its own weight. A possible approach provides for one or more guide rods that are arranged in parallel with the step pin. The guide rods can be fixed to the superstructure configuration, such as to the side part, whereby any forces introduced into the guide rods by the pin can be introduced on a direct path into the superstructure construction. The step pin has corresponding sliding surfaces that slide along the guide rods on the pin actuation.

The provision of a total of four or more guide rods is conceivable that are arranged symmetrically around the periphery of the step pin. The guide rods can be connected at the end sides, i.e. at their free ends, by means of a connection plate. The free rod end of the setting piston can also engage at this connection plate.

The configuration of the connection pin in accordance with the disclosure with at least one shoulder as an abutment surface has the result where applicable that the step pin additionally has to take up forces acting in the axial direction. Such axial forces are caused by the rotational movement of the superstructure, such as on the acceleration or deceleration of the superstructure. Since the step pin would forward the forces acting in the axial direction to the pin pulling device, but the latter is not designed for such forces under certain circumstances, it either has to be provided with larger dimensions or alternatively an additional force limitation device has to be provided. The latter could be provided by one or more additional locking means that block a linear movement of the pin during crane operation. Such locking means are directly connected to the superstructure construction to ensure a direct force transmission. In accordance with an embodiment variant, the locking means can be configured as locking pins that extend transversely to the axial axis of the pin. It is conceivable to fasten the locking pins to the superstructure construction via one or more force baffles. At the same time, the locking pins are indirectly or directly fastened to the step pin by corresponding mating connection means so that said step pin is fixed as a result and the acting axial forces can be introduced into the superstructure construction via the locking pins. The connection of the locking pins to the force baffles and/or mating connection means is designed as releasable to be able to release the lock connection to pull out the step pin.

It is conceivable that such locking pins can be installed directly at the surface structure at the end side by suitable force baffles, for instance while forming a form fit, whereby a direct leading off of the axial forces that occur into the superstructure construction is possible. The mating connection elements can be relief plates that are fixed to the step pin. The connection can also take place here between the relief plates and the locking pin.

BRIEF DESCRIPTION OF THE FIGURES

Further properties of the disclosure will be explained in more detail in the following with reference to an embodiment shown in the Figures. There are shown.

DETAILED DESCRIPTION

Figure 4:
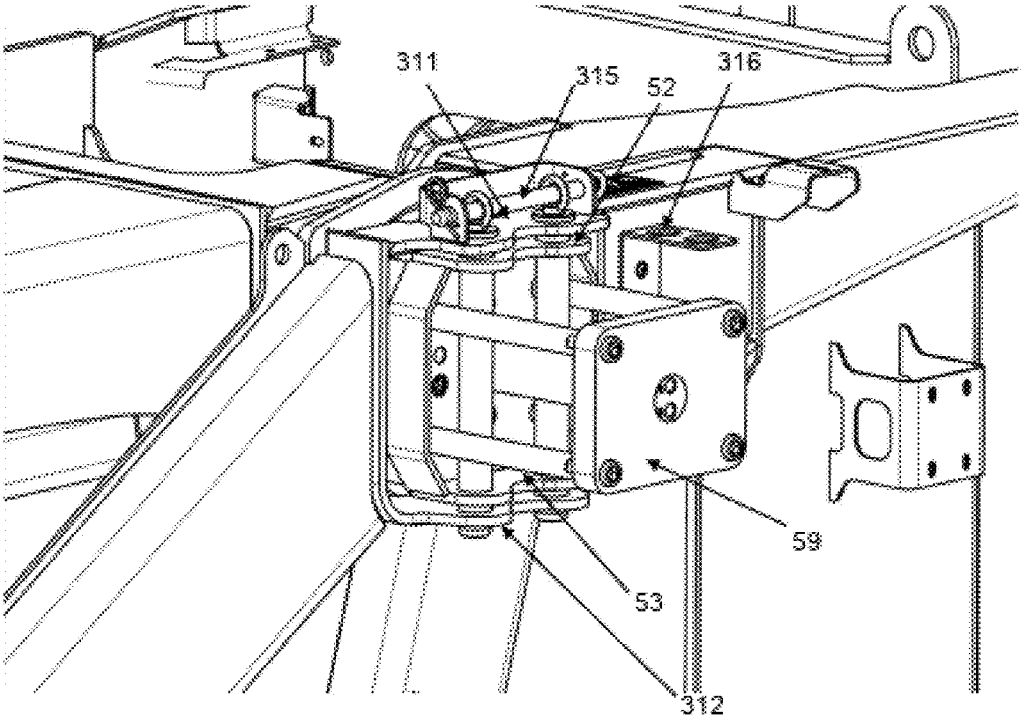
FIG. 4: a perspective side view of the pin pulling device.
Figure 5:
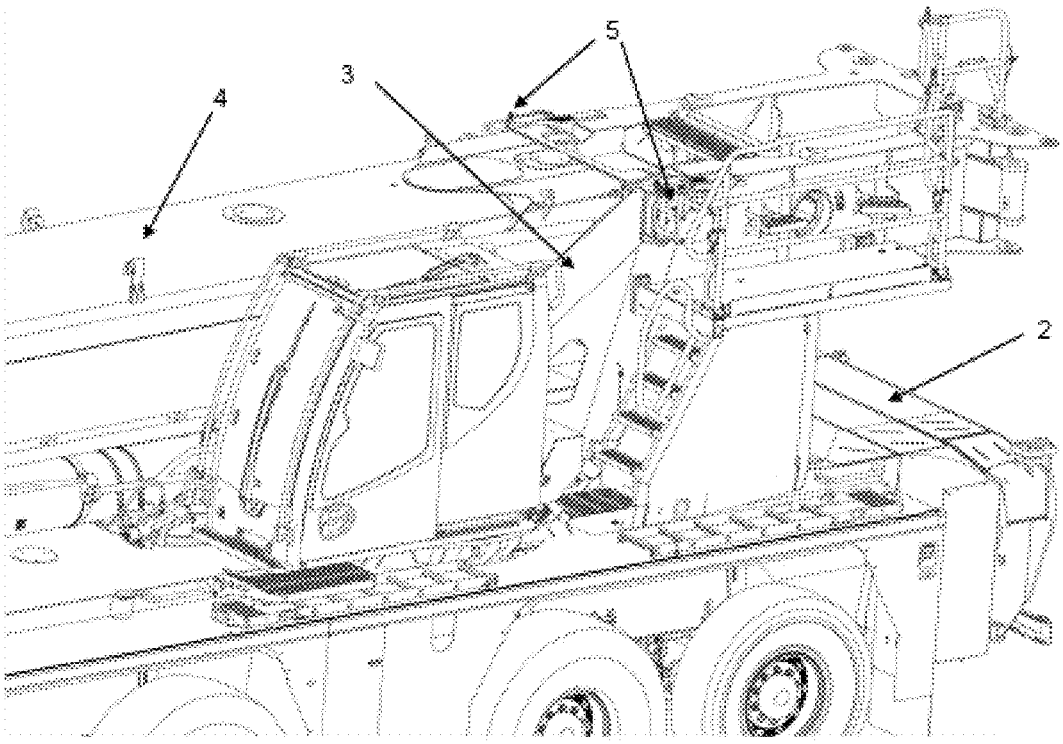
FIG. 5: a perspective side view of a mobile crane whose boom is connected to the superstructure construction via the pin connection in accordance with the disclosure.

The installation and dismantling of a boom at the superstructure of a mobile crane should be simplified by the solution in accordance with the disclosure. FIG. 5 shows a detailed section of such a mobile crane comprising an undercarriage 2 having a chassis, with a superstructure 3 being placed thereon rotatable about a vertical axis. A main boom 4 is connected, for example, pinned, in an articulated manner to the superstructure luffable about a horizontal axis. Two pinning points 5 with connection pins 50 in accordance with the disclosure that are pushed in the direction of the luffing axis of the boom 4 from the outside are required for the pin connection, Details of the pinning points 5 in accordance with the disclosure will be discussed in the following with reference to the detail views shown in FIGS. 1 to 4. The pinning point 5 between the boom 4 and the superstructure 3 is substantially formed by two parallel side walls 31*a*, 31*b* of the superstructure 3 that are spaced apart from one another by a clear width to provide space for introducing a connection part 4*a* of the boom 4. Both wide walls 31*a*, 31*b* and the connection part 4*a* of the boom 4 are equipped with bores 4*b* for receiving a connection pin 50. A boom bushing 7 is additionally introduced into the bore 4*b* of the connection part 4*a*.

To simplify the installation/dismantling of the boom 4, the width of the boom 4 that is defined via the outer spacing of the end faces of the boom bushing 7 is kept smaller than the clear width of the steel construction in the superstructure 3, i.e. between the side parts 31*b* on the left and right sides. The axial play of the connection part 4*a* and of the respective side wall 31*b* thus achieved on the left and right sides should respectively be in the range of 5 mm. This would be sufficient for a substantially faster installation and dismantling of the boom 4.

The connection pin 50 used is designed as a step pin 50 that has a shoulder 51 having a larger diameter as a substantial feature. The shoulder 51 projects slightly out of the bore 31*c* of the right side wall 31*b* into the clear space between the side walls 31*a*, 31*b* in the installed state (see FIG. 2). The shoulder 51 additionally also projects toward the outside on the oppositely disposed side of the side wall 31*b* in the pushed-in pin state. The part of the shoulder 51 projecting into the clear width between the side parts 31*a*, 31*b* forms an abutment for the front face of the boom bushing 7 so that the axial play of the boom is ultimately limited within the two side parts 31*a*, 31*b*. The geometrical design of the shoulder 51 is important here. It must be selected sufficiently large so that it can take up the axial force from the front face of the boom bushing 7. The surface pressure that has to be transferred in a harmless manner must be observed here.

The design is mirror inverted, but otherwise identical, for both pin points in accordance with FIG. 5. On the dismantling, the shoulder 51 together with the step pin 50 moves away from the boom bushing 7 and the available play increases. The boom 4 can be easily removed from the auxiliary crane. The installation is equally more simply possible due to the now existing axial play.

In the dimensioning of the step pin and also of the bearing points within the side walls 31*a*, 31*b*, the statistical notch in the pin 30 has to be observed that is present due to the diameter variation. The boom bushing 7 introduces a perpendicular force (radial to the bearing point) into the bearing region (side walls 31*a*, 31*b*) of the step pin 50. One of the two abutments of the step pin 50, the outer side wall 31*b* here, has a larger bore diameter for the pin leadthrough since the shoulder 51 of the step pin 50 has to be supported in this region. The cross-sectional change is thus located in the heavily loaded region of the step pin 50. The step pin 50 does not only have to be able to endure this load without damage and in the long term, but this capability must also be demonstrated by calculation with the necessary safety supplements.

An axial force, i.e. in the axial direction of the pin 50, can arise in crane operation in addition to the radial force. This force is mainly caused by starting or braking in slewing gear operation. The load here has to be laterally accelerated, whereby lateral forces arise in the pin connection 5 of the boom 4. This axial force predominantly has to be taken up by the shoulder 51 in the solution in accordance with the disclosure and the step pin 50 would forward the force to a pin pulling device 10 installed outwardly at the superstructure construction 3.

The pin pulling device 10 is hydraulically actuable, with the hollow step pin 50 forming the cylinder chamber 50*a*. A setting piston 57 is disposed within the chamber 50*a* and the latter is closed in a pressure-tight manner by means of the termination plate 58. The rod of the setting piston 57 is led through to the outside via a rod leadthrough of the termination plate 58.

Figure 1:
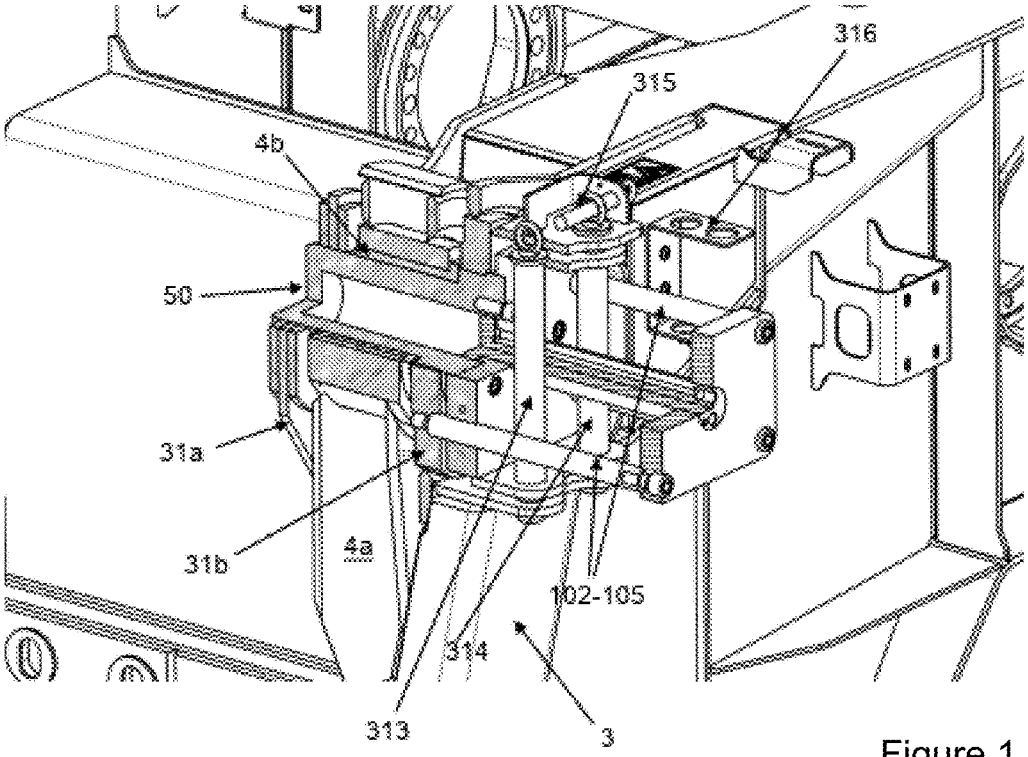
FIGS. 1 to 3: different perspective sectional representations of the innovative pin connection between the boom and the superstructure with an inserted step pin.
Figure 2:
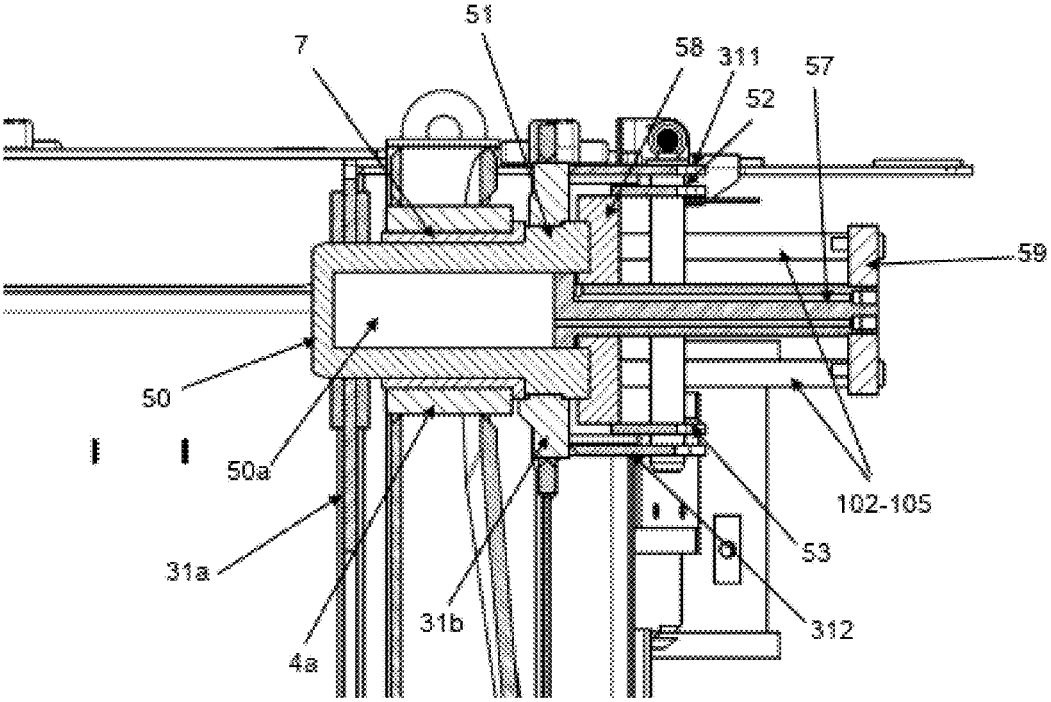
Figure 3:
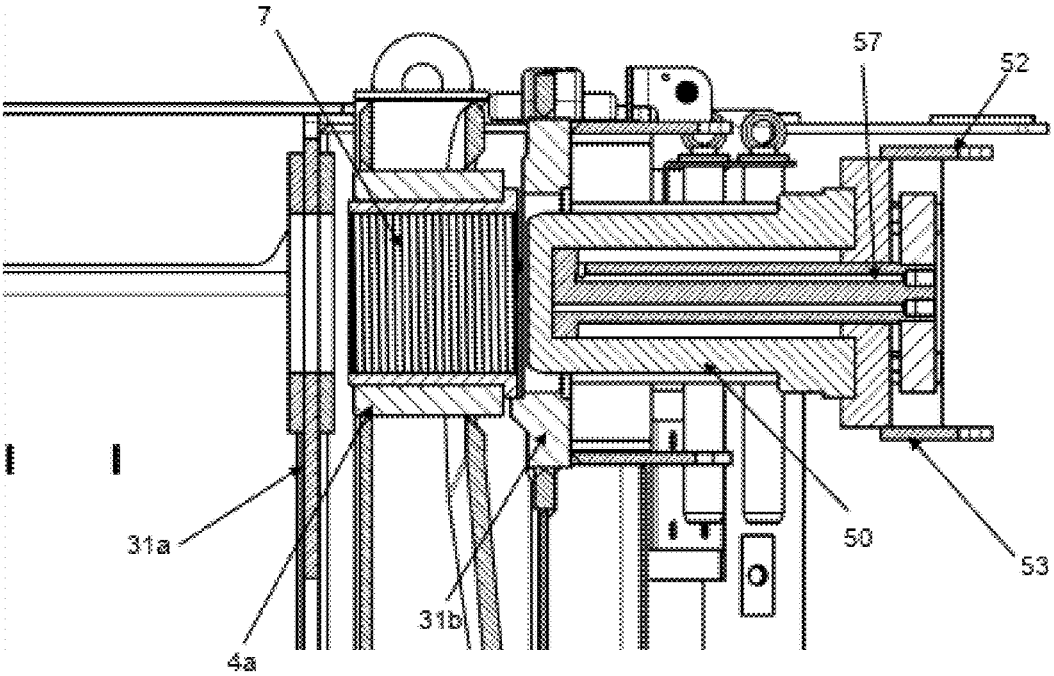

The design of the inner hydraulic components of the pin pulling device 10 can, however, not be designed as so strong that it could take up the axial force to be borne by the shoulder 51 in crane operation. The pin pulling device 10 has to be protected from the axial force in crane operation for this reason. This is achieved by a latch device 101 (FIGS. 1 and 4). It includes the two force baffles 311, 312 that are fastened to the superstructure construction 3 above and below the displacement path of the step pin. Each of these force baffles 311, 312 provides two leadthroughs through which latching pins 313, 314 can be pushed, and indeed such that they extend in parallel with one another in the vertical direction. Relief plates 52, 53 that likewise have leadthroughs for receiving the latching pins 313, 314 are provided as mating connection elements at the connection plate 58 or directly at the step pin 50. If the latching pins 313, 314 are pushed through the leadthroughs into the force baffles 311, 312 or the relief plates 52, 53, the step pin 50 is fixed, as is shown in FIG. 4, for example. The axial forces acting on the step pin 50 are thus introduced directly into the superstructure construction 3 via the latching pins 313, 314 and the force baffles 313, 314 and the pin pulling device 10 is thereby effectively protected.

The upper end of the latching pins 313, 314 projecting over the upper force baffle 311 has an eyelet through which a securing pin 315 can be pushed. When not in use, i.e. when the step pin 50 is to be pulled, the securing pin 315 is removed and the latching pins 313, 314 can be pulled out upwardly out of the plates 311, 312, 52, 53. The latching pins 313, 314 can be stowed at the superstructure 3 by means of the holder 316.

Due to the step-like design of the step pin 50, its diameter additionally varies in the direction of displacement. The bore diameter of the outer side part 31*b* of the superstructure 3 is coordinated with the diameter of the shoulder 51. If the step pin 50 is pulled by the pin pulling device 10, the diameter-reduced part of the step pin 50 is located in the bore 31*c* of the side part 31*b* and a sufficient support is no longer ensured (see FIG. 3). The forces and torques caused by its own weight have to be taken up by additional guide means in this position. For this purpose, a total of four guide rods 102-105 are arranged around the bore of the side part 31*b* that extend outwardly in the displacement direction of the pin. The free ends of the guide rods 102-105 are connected to one another via an end plate 59. The oppositely disposed end of the guide rods 102-105 is connected to the side part. The termination plate 58 of the step pin 50 is guided by sliding surfaces along the respective guide rods 102-105.

The free end of the piston rod 57 is additionally installed at the end plate 59; a connection position for the hydraulic supply of the pin pulling device are equally accommodated there.

FIGS. 1-5 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A mobile crane comprising a boom and a superstructure having at least one bearing point for pinning on the boom, wherein the at least one bearing point comprises two spaced apart side parts that each have a bore for receiving a pin; and wherein the boom comprises at least one connection part that is provided with a bore and that can be introduced between the two spaced apart side parts such that a common connection pin can be pushed through the bores of the two spaced apart side parts and the at least one connection part, wherein a clear width between the two spaced apart side parts is larger than a width of the at least one connection part of the boom; and in that a step pin is provided as a connection pin and a formed shoulder of the step pin forms an abutment for the at least one connection part of the pinned boom in the pinned position, and wherein a pin diameter for forming the step is larger than a diameter of a bushing inserted into the bore of the at least one connection part; and in that the step forms an abutment for a front face of the bushing.

2. A mobile crane comprising a boom and a superstructure having at least one bearing point for pinning on the boom, wherein the at least one bearing point comprises two spaced apart side parts that each have a bore for receiving a pin; and wherein the boom comprises at least one connection part that is provided with a bore and that can be introduced between the two spaced apart side parts such that a common connection pin can be pushed through the bores of the two spaced apart side parts and the at least one connection part, wherein a clear width between the two spaced apart side parts is larger than a width of the at least one connection part of the boom; and in that a step pin is provided as a connection pin and a formed shoulder of the step pin forms an abutment for the at least one connection part of the pinned boom in the pinned position, wherein the formed shoulder of the step pin projects into a space between the two spaced apart side parts and the at least one connection part in the pinned position and limits play of the pinned boom in an axial direction of the step pin, and wherein a pin pulling device is provided for automatic pulling and pushing of the step pin.

3. The mobile crane in accordance with claim 2, wherein the step pin is pushed or pushable in a direction toward a boom luffing axis.

4. The mobile crane in accordance with claim 2, wherein the pin pulling device comprises a hydraulic cylinder as an actuator whose cylinder is formed by a hollow space of the step pin, with a setting piston being fixed to the superstructure in a stationary manner and the step pin being linearly displaceable on the setting piston.

5. The mobile crane in accordance with claim 2, wherein one or more guide rods are provided along which the step pin is linearly displaceably guided.

6. The mobile crane in accordance with claim 5, wherein one or more latching pins are provided that extend transversely to the axial direction of the step pin and that limit an axial movement of the pin in the pulling direction.

7. The mobile crane in accordance with claim 6, wherein the one or more latching pins are directly supported at the superstructure to introduce axial forces acting on the pushed-in step pin directly into the superstructure.

8. The mobile crane in accordance with claim 6, wherein the one or more latching pins are releasably connected to the superstructure via at least one force baffle in a form fitting manner and to the step pin via relief plates.

9. The mobile crane in accordance with claim 5, wherein one or more guide rods are installed at the superstructure.

10. The mobile crane in accordance with claim 9, wherein the one or more guide rods are installed at the two spaced apart side parts of the superstructure.

11. The mobile crane in accordance with claim 2, wherein the pin pulling device is arranged outwardly at one of the two spaced apart side parts.

* * * * *